US010156055B2

(12) United States Patent
Kovar et al.

(10) Patent No.: US 10,156,055 B2
(45) Date of Patent: Dec. 18, 2018

(54) INTEGRATED EXCAVATOR PIN GRABBER QUICK COUPLER

(71) Applicant: Caterpillar Inc., Peoria, IL (US)

(72) Inventors: Aaron D. Kovar, Topeka, KS (US); Derek E. Akin, Topeka, KS (US)

(73) Assignee: Caterpillar Inc., Deerfield, IL (US)

( * ) Notice: Subject to any disclaimer, the term of this patent is extended or adjusted under 35 U.S.C. 154(b) by 0 days.

(21) Appl. No.: 15/479,428

(22) Filed: Apr. 5, 2017

(65) Prior Publication Data

US 2017/0321389 A1 Nov. 9, 2017

Related U.S. Application Data

(60) Provisional application No. 62/332,792, filed on May 6, 2016.

(51) Int. Cl.

| | |
|---|---|
| ***E02F 3/36*** | (2006.01) |
| ***E02F 3/32*** | (2006.01) |
| ***E02F 9/22*** | (2006.01) |

(52) U.S. Cl.

CPC ..... *E02F 3/3636* (2013.01); *E02F 3/32* (2013.01); *E02F 3/3618* (2013.01); *E02F 3/3631* (2013.01); *E02F 3/3663* (2013.01); *E02F 9/2271* (2013.01)

(58) Field of Classification Search

CPC ..... E02F 3/3618

See application file for complete search history.

(56) References Cited

U.S. PATENT DOCUMENTS

| | | | | | |
|---|---|---|---|---|---|
| 4,295,287 | A | * | 10/1981 | Natzke | E02F 3/3622 403/316 |
| 4,643,631 | A | | 2/1987 | Maurer et al. | |
| 5,382,110 | A | * | 1/1995 | Perotto | E02F 3/3622 172/272 |
| 5,400,531 | A | | 3/1995 | Brown | |
| 5,549,440 | A | * | 8/1996 | Cholakon | E02F 3/3622 37/468 |
| 6,042,295 | A | | 3/2000 | Barden | |

(Continued)

FOREIGN PATENT DOCUMENTS

| | | |
|---|---|---|
| DE | 4109783 | 9/1991 |
| EP | 3009570 | 4/2016 |

(Continued)

*Primary Examiner* — Gerald McClain

(74) *Attorney, Agent, or Firm* — Finnegan, Henderson, Farabow, Garrett & Dunner, LLP

(57) ABSTRACT

A tool coupler assembly may include a power linkage assembly, and the power linkage assembly may include a first power link. The first power link may include a first end configured for pivotal connection to a tool, and a second, opposite end configured for pivotal connection to one end of a tool control actuator. The tool control actuator may be connected at an opposite end to a first end of a tool support member of a machine, wherein operation of the tool control actuator pivots the tool about a tool pivot axis coaxial with a tool engagement interface at a second end of the tool support member. A power linkage actuator may be pivotally connected at a first end for coaxial rotation with the tool engagement interface at the second end of the tool support member, and at a second end for coaxial rotation with the first end of the first power link.

19 Claims, 10 Drawing Sheets

(56) References Cited

U.S. PATENT DOCUMENTS

| | | | | | |
|---|---|---|---|---|---|
| 6,074,120 | A * | 6/2000 | Williams | E02F 3/3609 | 37/468 |
| 6,158,950 | A * | 12/2000 | Wilt | E02F 3/3622 | 37/468 |
| 6,308,442 | B1 * | 10/2001 | Naka | E02F 3/3622 | 37/468 |
| 6,350,079 | B1 * | 2/2002 | Williams | E02F 3/3622 | 37/468 |
| 6,438,875 | B1 * | 8/2002 | Kimble | E02F 3/3663 | 37/468 |
| 6,606,805 | B2 | 8/2003 | Kimble et al. | | |
| 7,621,689 | B2 * | 11/2009 | Nishioka | E02F 3/3622 | 37/468 |
| 8,281,506 | B2 | 10/2012 | Stefek et al. | | |
| 2002/0136597 | A1 | 9/2002 | Nishikawa et al. | | |
| 2014/0231564 | A1 * | 8/2014 | Van Gemert | E02F 3/3622 | 241/264 |

FOREIGN PATENT DOCUMENTS

| | | | | | |
|---|---|---|---|---|---|
| EP | 3009570 | A1 * | 4/2016 | E02F 3/308 | |
| JP | 2009127254 | A * | 6/2009 | E02F 3/3622 | |
| WO | WO-2010104278 | A2 * | 9/2010 | E02F 3/3618 | |

* cited by examiner

INTEGRATED EXCAVATOR PIN GRABBER QUICK COUPLER

TECHNICAL FIELD

The present disclosure relates generally to a tool coupler and, more particularly, to an integrated excavator pin grabber quick coupler.

BACKGROUND

Machines, for example backhoes, excavators, graders, and loaders, commonly have a power linkage that is movable to control the motion of a connected tool such as a bucket, a blade, a hammer, or a grapple. When equipped with a single tool, these machines become specialized machines that are primarily used for a single purpose. Although adequate for some situations, the single purpose machines can have limited functionality and versatility. A tool coupler assembly can be used to increase the functionality and versatility of a host machine by allowing different tools to be quickly and interchangeably connected to the power linkage of the machine.

Tool coupler assemblies are generally known and include a frame connected to the linkage of a machine, and hooks or latches that protrude from the frame. The hooks of a tool coupler assembly engage corresponding pins of a tool to thereby connect the tool to the linkage. To help prevent undesired disengagement of the hooks from the pins, tool coupler assemblies can be equipped with a hydraulic piston that locks the hooks in place against the pins.

When connecting or disconnecting a tool to a host machine, precautions should be taken to help ensure the procedure is performed properly. For example, the tool should be in a desired resting position before decoupling is performed so that the tool does not move in an unexpected manner after the decoupling. In addition, fluid provided to the hydraulic piston of the tool coupler assembly should be at a pressure that allows proper operation of the tool coupler assembly without causing damage to the assembly.

U.S. Pat. No. 8,281,506 to Stefek et al. (the '506 patent) describes a tool coupler assembly that includes a frame connected to a linkage of a machine, and hooks or latches that protrude from the frame. The hooks of the tool coupler assembly frame engage corresponding pins of a tool to thereby connect the tool to the linkage. A tool coupler hydraulic piston locks the hooks in place against the pins. The tool coupler assembly of the '506 patent includes an offset between the pins on the tool and the point on the frame of the tool coupler assembly where a force is applied to pivot the tool about one of the pins. This offset may add additional tip radius to the machine, and may reduce the overall breakout forces seen at the bucket tips. The frame of the tool coupler assembly in the '506 patent may also add weight and additional cost for the tool coupler assembly.

The tool coupler assembly of the present disclosure addresses one or more of the characteristics set forth above and/or other problems of the prior art.

SUMMARY

One aspect of the present disclosure is directed to a tool coupler assembly. The tool coupler assembly may include a power linkage assembly, and the power linkage assembly may include a first power link. The first power link may include a first end configured for pivotal connection to a tool, and a second, opposite end configured for pivotal connection to one end of a tool control actuator. The tool control actuator may be connected at an opposite end to a first end of a tool support member of a machine, wherein operation of the tool control actuator pivots the tool about a tool pivot axis coaxial with a tool engagement interface at a second end of the tool support member. A power linkage actuator may be pivotally connected at a first end for coaxial rotation with the tool engagement interface at the second end of the tool support member, and at a second end for coaxial rotation with the first end of the first power link.

Another aspect of the present disclosure is directed to a machine. The machine may include a base frame, a boom member pivotally connected at one end to the base frame, at least one actuator connected to move the boom member relative to the base frame, a stick member pivotally connected at a first end to the boom member, at least one actuator connected between the boom member and the stick member to move the stick member relative to the boom member, and a tool pivotally connected to a second end of the stick member opposite from the first end. The machine may also include a tool coupler assembly including a power linkage assembly. The power linkage assembly may include a first power link, and the first power link may include a first end configured for pivotal connection to the tool, and a second, opposite end configured for pivotal connection to one end of a tool control actuator. The tool control actuator may be connected at an opposite end to a first end of the stick member, wherein operation of the tool control actuator pivots the tool about a tool pivot axis coaxial with a tool engagement interface at the second end of the stick member. The tool coupler assembly may also include a power linkage actuator pivotally connected at a first end for coaxial rotation with the tool engagement interface at the second end of the stick member, and at a second end for coaxial rotation with the first end of the first power link.

Yet another aspect of the present disclosure is directed to a tool coupler. The tool coupler may include a power link having a first end pivotally connected to a tool and a second, opposite end pivotally connected to one end of a tool control hydraulic cylinder. The tool control hydraulic cylinder may be pivotally connected at an opposite end to a first end of a stick member of a machine, wherein operation of the tool control hydraulic cylinder causes the tool pivotally mounted at a second end of the stick member to pivot relative to the stick member about a tool pivot axis. A power linkage hydraulic cylinder may be pivotally connected at one of a head end and a rod end for coaxial rotation with a stick nose clevis-type collar at the second end of the stick member, and at the other of the head end and the rod end for coaxial rotation with a power linkage clevis-type collar at the first end of the power link.

DETAILED DESCRIPTION

Figure 1:
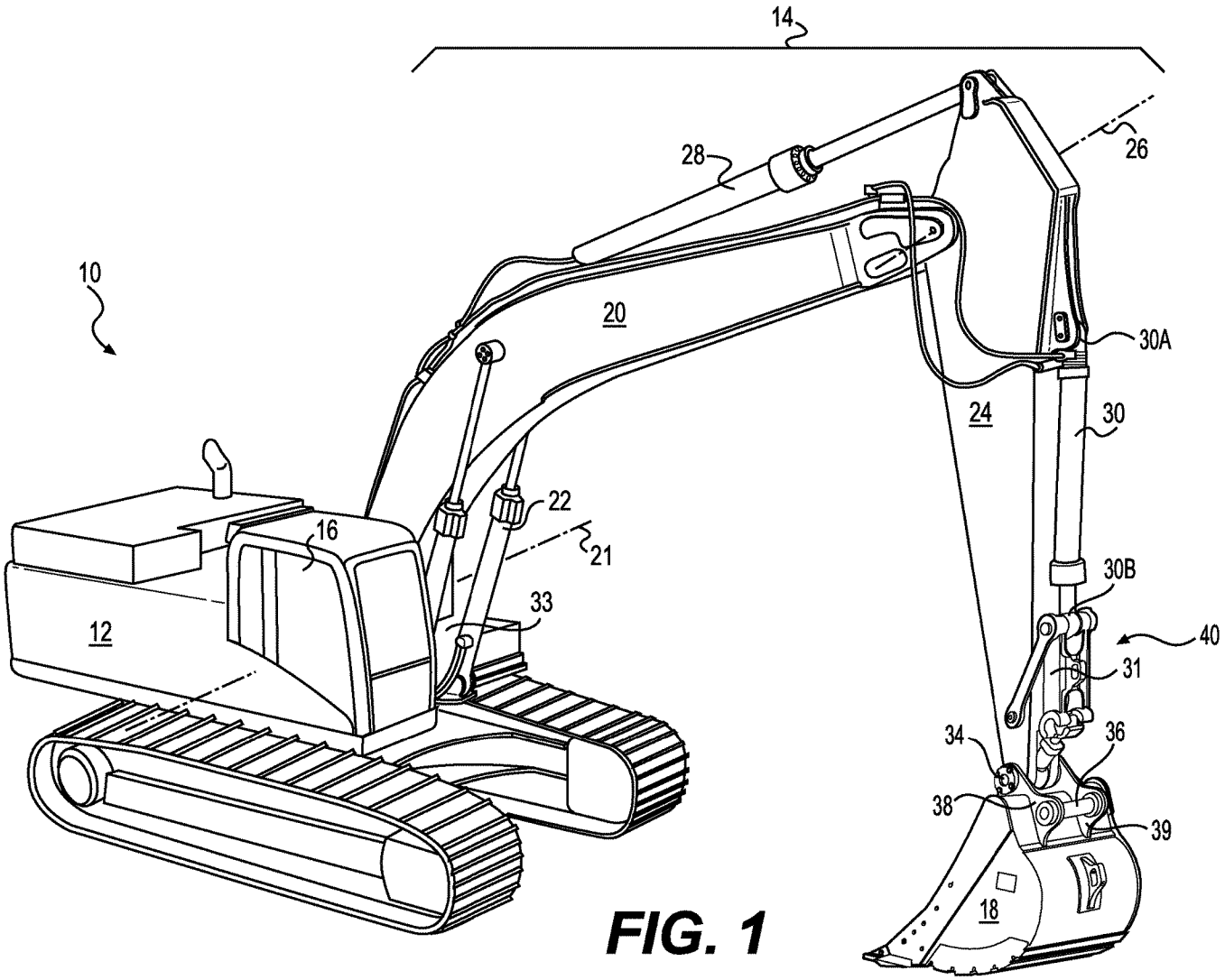
FIG. 1 is a pictorial illustration of an exemplary disclosed machine.

FIG. 1 illustrates an exemplary machine 10. Machine 10 may be a fixed or mobile machine that performs some type of operation associated with an industry, such as mining, construction, farming, transportation, or any other industry known in the art. For example, machine 10 may be an earth moving machine such as an excavator, a backhoe, a loader, or a motor grader. Machine 10 may include a power source 12, a tool system 14 driven by power source 12, and an operator station 16 situated for manual control of tool system 14.

Figure 2:
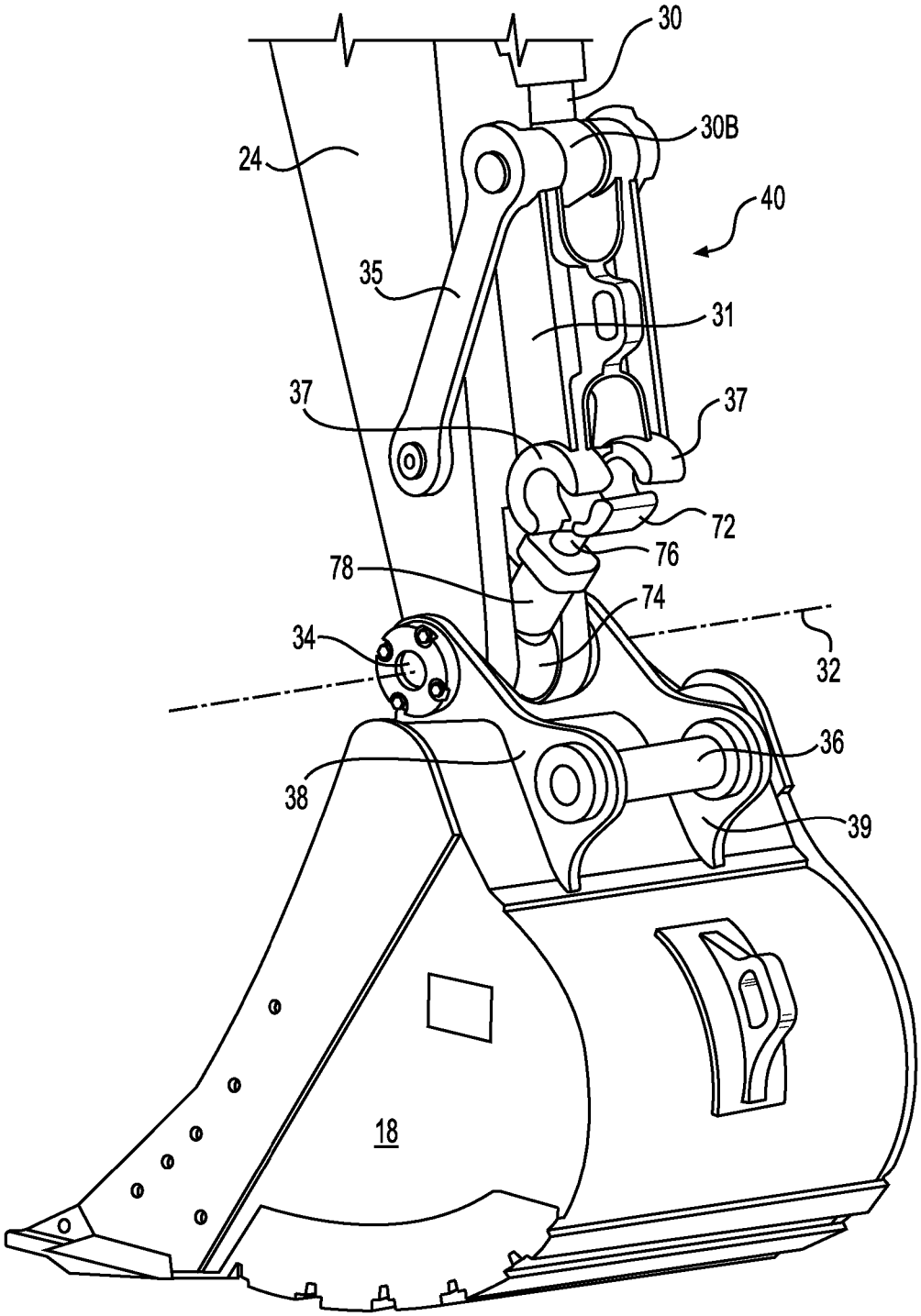
FIG. 2 is an illustration of a portion of the exemplary machine of FIG. 1, showing an enlarged view of a tool coupler assembly that may be used with the machine of FIG. 1.

Tool system 14 may include linkage acted on by hydraulic cylinders to move a tool 18. Specifically, tool system 14 may include a boom member 20 that is vertically pivotal about a horizontal boom axis 21 by a pair of adjacent, double-acting, hydraulic cylinders 22, and a stick member 24 that is vertically pivotal about a stick axis 26 by a single, double-acting, hydraulic cylinder 28. Tool system 14 may further include a single, double-acting, hydraulic cylinder 30 that is connected to vertically pivot tool 18 about a tool pivot axis 32 (FIG. 2). In one embodiment, hydraulic cylinder 30 may be connected at a head-end 30A to a portion of stick member 24, and at an opposing rod-end 30B to tool 18 by way of a first power link 31 of a tool coupler assembly 40. Boom member 20 may be pivotally connected to a frame 33 of machine 10. Stick member 24 may pivotally connect boom member 20 to tool 18.

Each of hydraulic cylinders 22, 28, and 30 may include a tube portion and a piston assembly arranged within the tube portion to form a head-end pressure chamber and a rod-end pressure chamber. The pressure chambers may be selectively supplied with pressurized fluid and drained of the pressurized fluid to cause the piston assembly to displace within the tube portion, thereby changing the effective length of hydraulic cylinders 22, 28, and 30. The flow rate of fluid into and out of the pressure chambers may relate to a velocity of hydraulic cylinders 22, 28, and 30, while a pressure differential between the head- and rod-end pressure chambers may relate to a force imparted by hydraulic cylinders 22, 28, and 30 on the associated linkage members. The expansion and retraction of hydraulic cylinders 22, 28, and 30 may function to assist in moving tool 18.

Numerous different tools 18 may be attachable to a single machine 10 and controllable via operator station 16. Tool 18 may include any device used to perform a particular task such as, for example, a bucket, a fork arrangement, a blade, a grapple, or any other task-performing device known in the art. Although connected in the embodiment of FIG. 1 to pivot relative to machine 10, tool 18 may additionally rotate, slide, swing, lift, or move in any other manner known in the art. Tool 18 may include front and rear tool pins 34, 36 that facilitate connection to tool system 14. Tool pins 34, 36 may be joined at their ends by a pair of spaced apart tool brackets 38, 39 that are welded to an external surface of tool 18.

Figure 3:
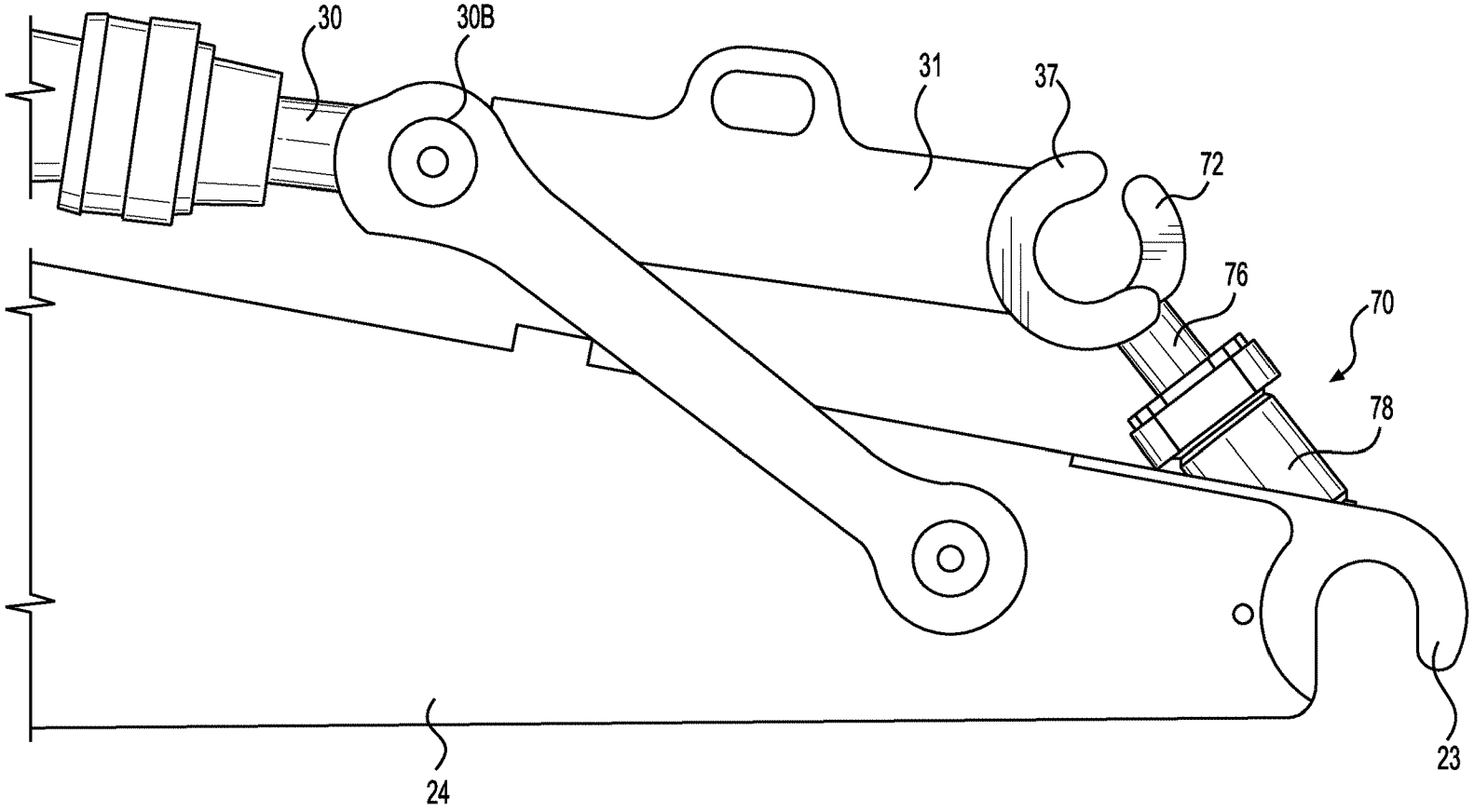
FIG. 3 is a pictorial illustration of the tool coupler assembly of FIG. 2 shown in a fully retracted position.
Figure 5:
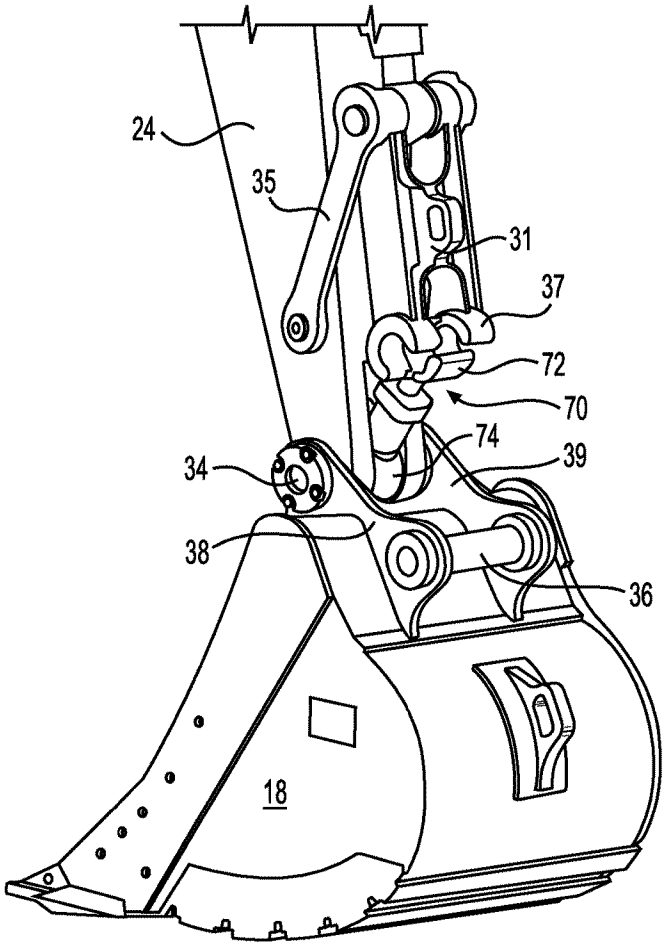
FIG. 5 is a pictorial illustration of the tool coupler assembly of FIG. 2 shown in the same fully retracted position as in FIG. 4.
Figure 4:
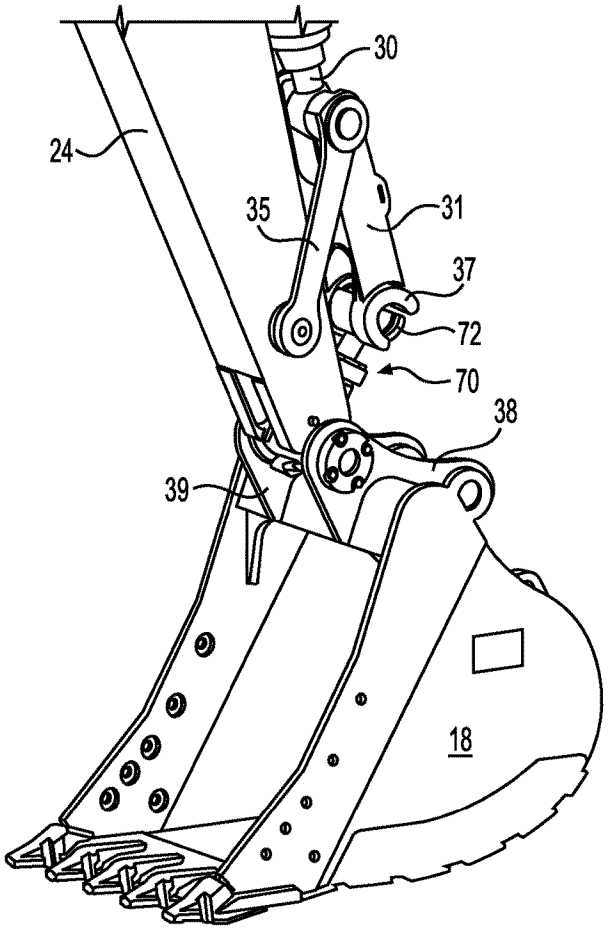
FIG. 4 is front perspective view of the tool coupler assembly of FIG. 2 shown in a fully retracted position with the power link unlatched from a rear pin on a tool.

Tool coupler assembly 40 may be located to facilitate a quick connection between the linkage of tool system 14 and tool 18. As shown in FIGS. 2 and 3, tool coupler assembly 40 may include a power linkage assembly, and a power linkage actuator 70. The power linkage assembly may include at least first power link 31, and a second power link 35. First power link 31 may include a first end configured for pivotal connection to tool 18, and a second, opposite end configured for pivotal connection to an end of a tool control actuator. In the exemplary embodiment of machine 10 illustrated in FIGS. 1 and 2, the tool control actuator is hydraulic cylinder 30. First power link 31 is connected at its second end for pivotal connection to end 30B of hydraulic cylinder 30. However, one of ordinary skill in the art will recognize that the tool control actuator may be an electric actuator, electro-hydraulic actuator, electro-mechanical, manual screw actuator, or other type of actuator that can be operated to change in length so as to exert a force at each end and move a linkage and a tool connected to one end of the tool control actuator relative to a tool support member connected at the opposite end of the actuator. The tool control actuator (hydraulic cylinder 30) may be connected at an opposite end from the end connected to first power link 31 to a first end of a tool support member of a machine, wherein operation of the tool control actuator pivots the tool about a tool pivot axis 32 coaxial with a tool engagement interface at a second end of the tool support member.

In the exemplary embodiment shown in FIG. 1, the tool support member of machine 10 is stick member 24, and operation of hydraulic cylinder 30 pivots tool 18 about tool pivot axis 32 coaxial with a stick nose clevis-type collar 23 at the second end of stick member 24. As will be explained in more detail below, the stick nose clevis-type collar 23 may include two, spaced-apart, C-shaped leg portions configured to slidably and coaxially receive a mating collar attached to one end of power linkage actuator 70. Each of the C-shaped leg portions of stick nose clevis-type collar 23 may further define aligned notch openings configured for slidable and coaxial engagement with front tool pin 34. In an alternative embodiment, one of ordinary skill in the art will recognize that the tool engagement interface at the second end of stick member 24 (the tool support member) may include a clevis-type collar on one or both ends of power linkage actuator 70 and a solid mating collar at the second end of stick member 24.

Power linkage actuator 70 may be pivotally connected at a first end for coaxial rotation with the tool engagement interface at the second end of the tool support member, and at a second end for coaxial rotation with the first end of first power link 31. In the exemplary embodiment shown in the figures, power linkage actuator 70 is a hydraulic cylinder, and the first end of power linkage actuator 70 is a head end 78, while the second end is a rod end 76 of the hydraulic cylinder. Head end 78 of power linkage actuator 70 may include a collar configured to be pivotally connected for coaxial rotation with stick nose clevis-type collar 23, while rod end 76 of power linkage actuator 70 may include a collar configured to be pivotally connected for coaxial rotation with another clevis-type collar 37 at the first end of first power link 31. One of ordinary skill in the art will recognize that the orientation of power linkage actuator 70 relative to tool coupler assembly 40 may be reversed, with head end 78 being pivotally connected for coaxial rotation with first power link clevis-type collar 37, and rod end 76 being pivotally connected for coaxial rotation with stick nose clevis-type collar 23. One factor that may affect which of head end 78 or rod end 76 is pivotally connected for coaxial rotation with the stick nose clevis-type collar 23 is the routing of hydraulic fluid supply lines that are connected to power linkage actuator 70 in the case of actuator 70 being a hydraulic actuator. In some implementations, it may be preferable to pivotally connect head end 78 for coaxial rotation with the stick nose clevis-type collar 23 in order to facilitate the routing of hydraulic fluid supply lines to actuator 70. Moreover, one of ordinary skill in the art will recognize that alternative embodiments may include solid collars at one or both ends of first power link 31 and a mating clevis-type collar at one or both ends of power linkage actuator 70.

As best seen in the exemplary embodiment illustrated in FIGS. 2, 3, 5, 6, and 10, head end 78 of power linkage actuator 70 may include a tool engagement interface having a C-shaped collar 74 configured to be pivotally connected for coaxial rotation with stick nose clevis-type collar 23 and front tool pin 34 along tool pivot axis 32. As best seen in FIGS. 2-9 and 11, rod end 76 of power linkage actuator 70 may also include a C-shaped collar 72 configured to be pivotally connected for coaxial rotation with rear tool pin 36 at a position spaced from tool pivot axis 32. As discussed above, one of ordinary skill in the art will recognize that the tool engagement interfaces at the second end of stick member 24, the first end of first power link 31, and both ends of power linkage actuator 70 may have alternative configurations with the clevis-type collar on one mating part and a solid collar that fits in between the legs of the clevis-type collar on the other mating part. In FIGS. 2-5, tool coupler assembly 40 is shown in a position with hydraulic cylinder 30 (the tool control actuator) fully retracted, and with stick nose clevis-type collar 23 and head end C-shaped collar 74 of power linkage actuator 70 in position for engagement and disengagement with front tool pin 34. In this fully retracted position, as best seen in FIG. 3, a notch opening into head end C-shaped collar 74 and a notch opening into stick nose clevis-type collar 23 are aligned such that stick member 24 (the tool support member) may be engaged and disengaged with front tool pin 34 on tool 18.

Figure 6:
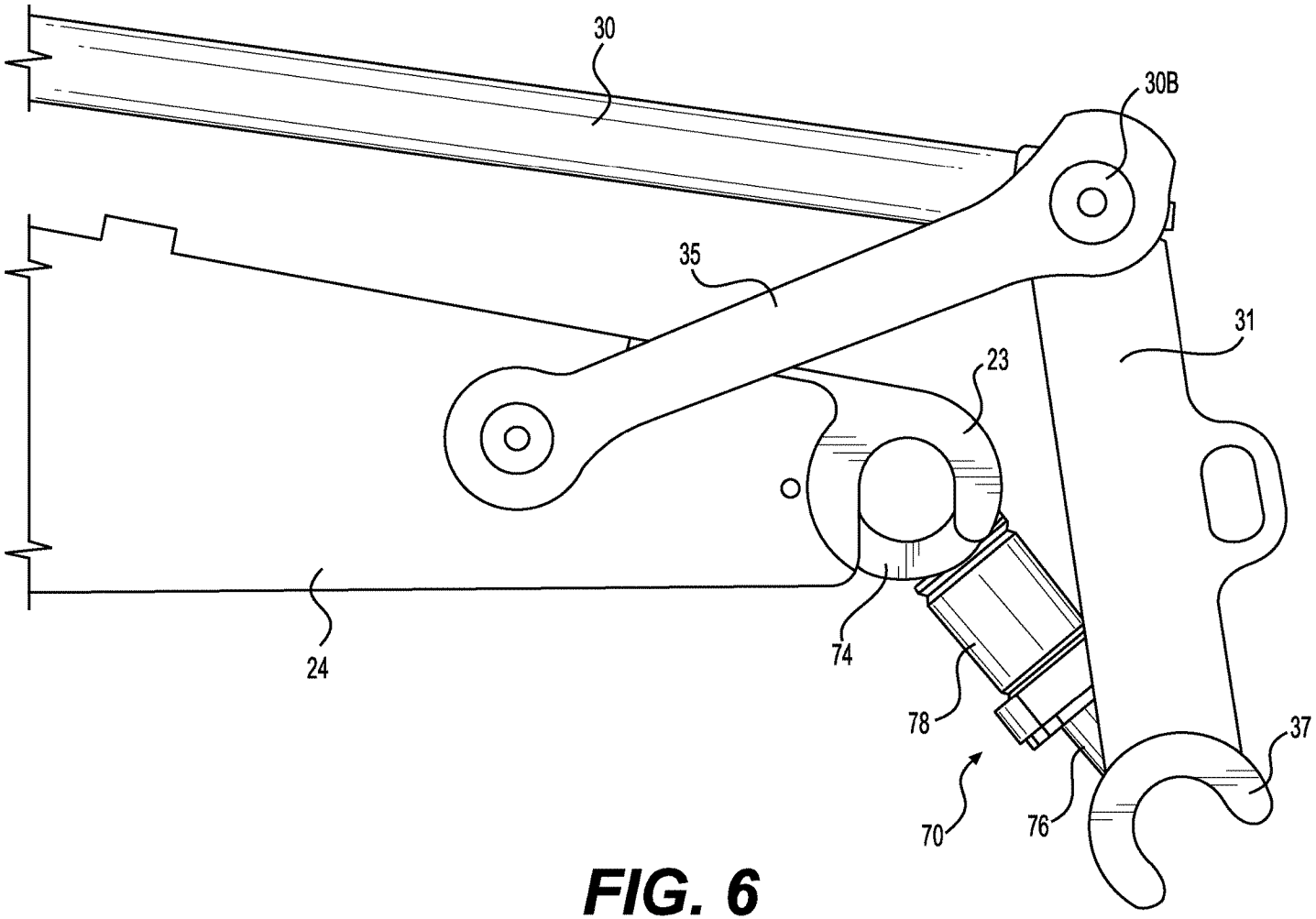
FIG. 6 is a pictorial illustration of the tool coupler assembly of FIG. 2 shown in a fully extended position.
Figure 8:
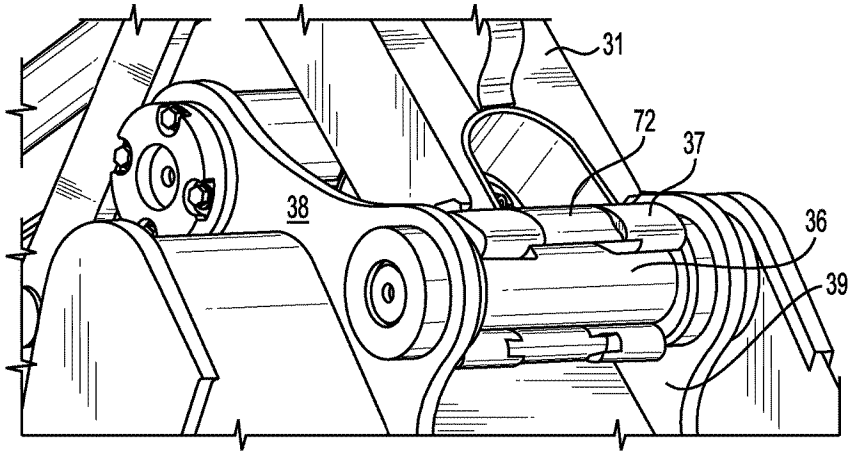
FIG. 8 is an enlarged view of a portion of FIG. 7, illustrating the connection between the power link of the tool coupler assembly and the rear pin on a tool.
Figure 7:
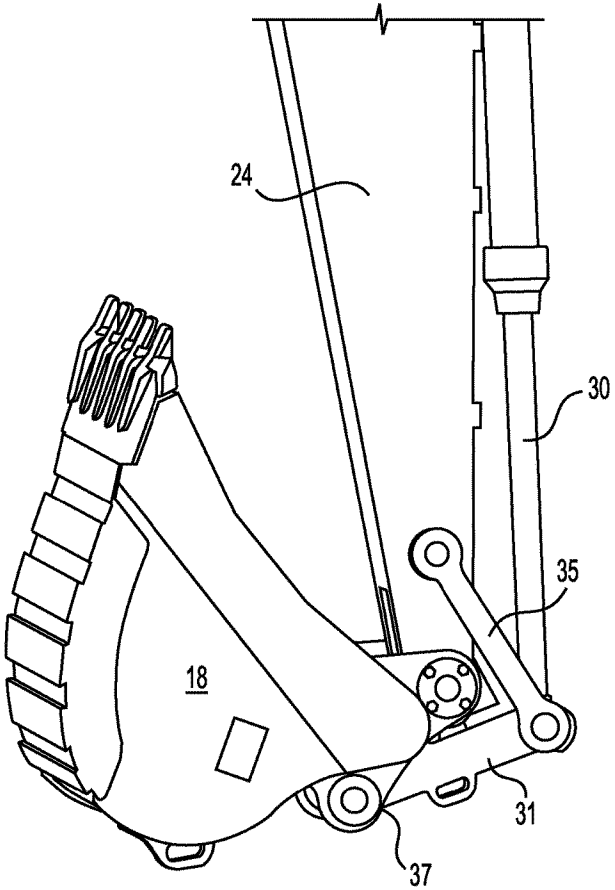
FIG. 7 is a pictorial illustration of the tool coupler assembly of FIG. 2 shown in a fully extended position and connected to front and rear pins on a tool.

In FIGS. 6-8, tool coupler assembly 40 is shown in a position with hydraulic cylinder 30 fully extended. In this fully extended position, the notch opening into power linkage actuator head end C-shaped collar 74 and the notch opening into stick nose clevis-type collar 23 are no longer aligned, thereby trapping front tool pin 34 for coaxial rotation with both collars 74, 23. Furthermore, in this fully extended position of hydraulic cylinder 30, first power link clevis-type collar 37 and rod end C-shaped collar 72 of power linkage actuator 70 are in position for engagement and disengagement from rear tool pin 36. In this fully extended position, as best seen in FIG. 6, a notch opening into rod end C-shaped collar 72 and a notch opening into first power link clevis-type collar 37 are aligned such that first power link 31 may be engaged and disengaged from rear tool pin 36.

Figure 11:
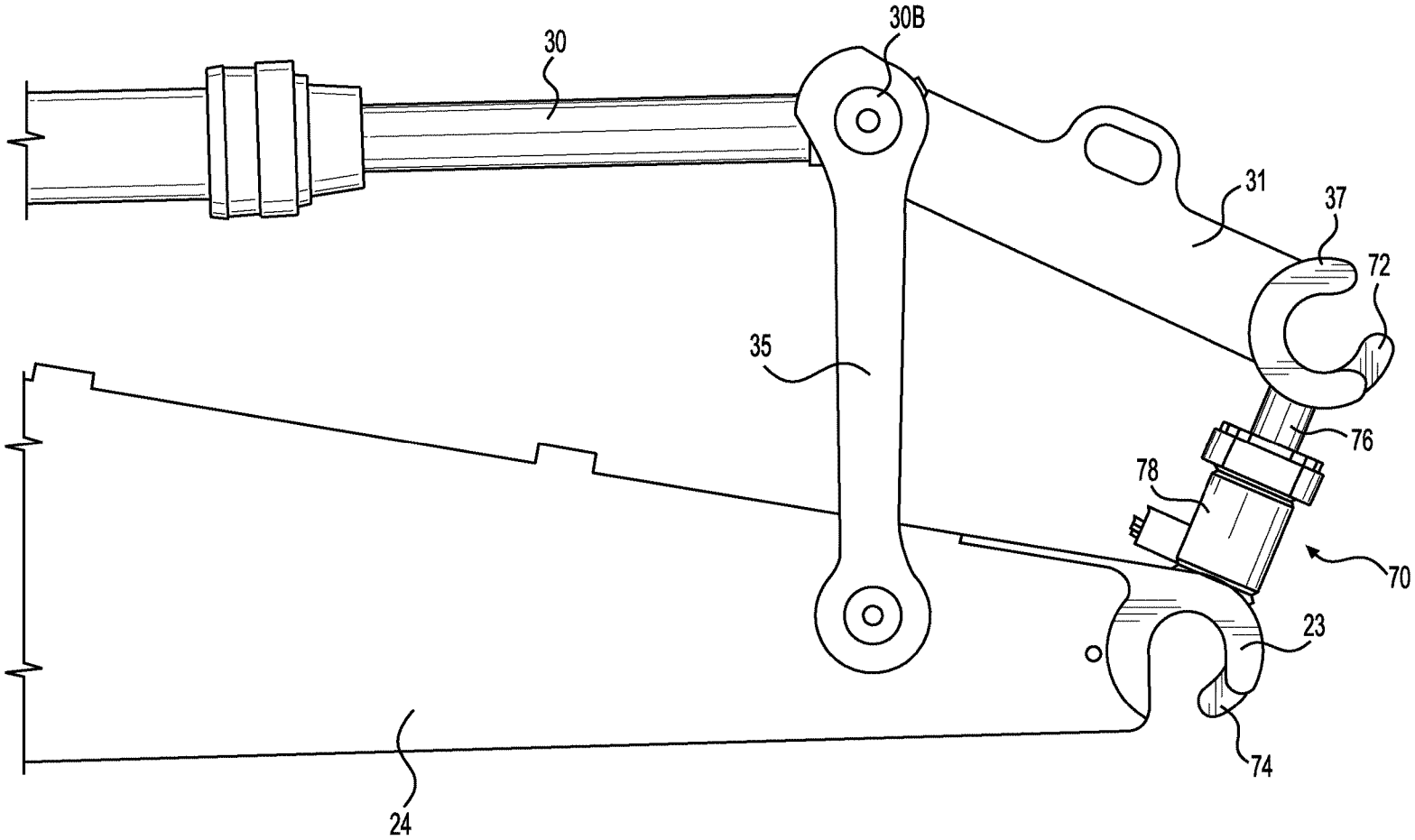
FIG. 11 is a pictorial illustration of the tool coupler assembly of FIG. 2 shown in an intermediate position between fully retracted and fully extended.

FIG. 11 illustrates a position of tool coupler assembly 40 with hydraulic cylinder 30 at a position in between fully retracted and fully extended. In this position, and any position in between full extension and full retraction of hydraulic cylinder 30, the notch openings of rod end C-shaped collar 72 of power linkage actuator 70 and first power link clevis-type collar 37 are misaligned, and the notch openings of head end C-shaped collar 74 of power linkage actuator 70 and stick nose clevis-type collar 23 are misaligned. Therefore, stick nose clevis-type collar 23 and head end collar 74 may be engaged with front tool pin 34 when hydraulic cylinder 30 is fully retracted, and first power link clevis-type collar 37 and rod end collar 72 may be engaged with rear tool pin 36 when hydraulic cylinder 30 is fully extended. In the fully extended and fully retracted positions, power linkage actuator 70 may be actuated in an extension direction in order to exert a force against tool pins 34, 36 and prevent the pins from disengaging with the aligned notch openings. In all positions between full retraction and full extension of hydraulic actuator 30, the misalignment of the notch openings in the collars prevents disengagement with the tool pins 34, 36. Therefore, power linkage actuator 70 can be maintained in a fixed position such that the distance between rod end collar 72 and head end collar 74 remains the same throughout extension and retraction of hydraulic cylinder 30.

Figure 9:
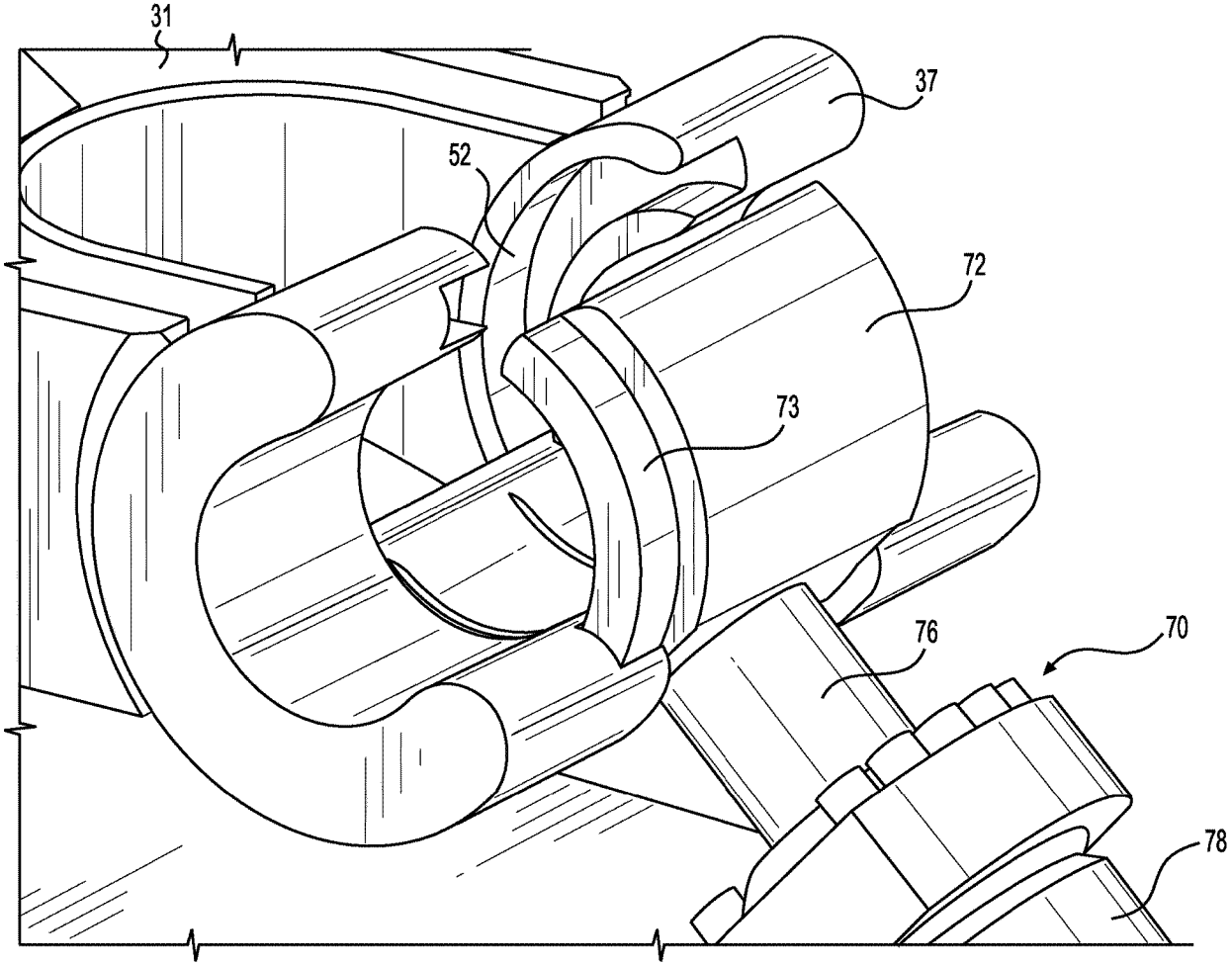
FIG. 9 is an enlarged perspective view of the interconnection between the power link of the tool coupler assembly and one end of the power linkage hydraulic actuator.
Figure 10:
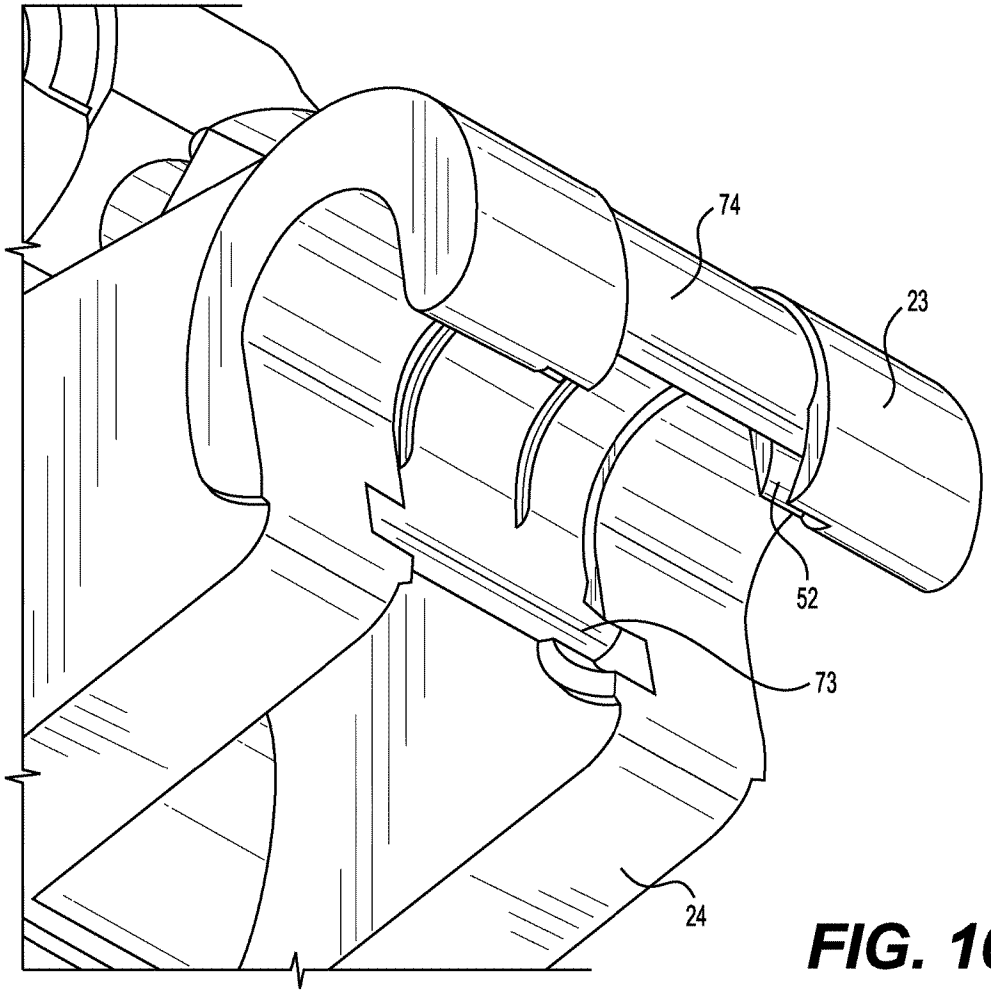
FIG. 10 is an enlarged perspective view of the interface between a collar at one end of the power linkage hydraulic actuator and a clevis-type collar at one end of a stick member of the machine.

As best seen in the perspective view of FIG. 2, the side view of FIG. 3, and the enlarged perspective views of FIGS. 9 and 10, stick nose clevis-type collar 23 and first power link clevis-type collar 37 may be split, C-shaped collars with aligned notches defining an opening between circumferential ends of each portion of each of the split, C-shaped collars. The C-shaped collars may be configured such that the notch openings in each of stick nose clevis-type collar 23 and first power link clevis-type collar 37 are at least large enough to receive front and rear tool pins 34, 36 on tool 18. In the embodiments shown in the figures, the C-shaped collars extend arcuately over approximately 180 degrees or less, and are configured to slidably mate with approximately one half of the outer circumferential surface of the pins 34, 36, or with bushings that are provided around engagement portions of the pins. Moreover, the forked ends of stick member 24 and first power link 31 with spaced-apart C-shaped collar portions provide clearance for at least a portion of power linkage actuator 70 so that there will be no interference between stick member 24, first power link 31, and power linkage actuator 70 throughout the full range of motion.

First, front tool pin 34 may be coaxial with tool pivot axis 32, and both first tool pin 34 and second, rear tool pin 36 may be connected to at least one bracket 38, 39 joined with an upper surface of tool 18. Second pin 36 may be located in a position behind first pin 34. The collar notch openings in stick nose clevis-type collar 23 at the second end of stick member 24 may be configured to engage with first, front pin 34, or with one or more bushings positioned concentrically around the outer circumferential periphery of pin 34. Similarly, the collar notch openings in first power link clevis-type collar 37 may be configured to engage with second, rear pin 36, or with one or more bushings located concentrically around the outer periphery of pin 36.

The C-shaped collars at the head end 78 and rod end 76 of power linkage actuator 70, and at the stick nose 23 and the first end 37 of power link 31 may be pivotally connected for coaxial rotation with each other and with the tool pins 34, 36. The configuration of the collars also allows for quick engagement and disengagement of the stick nose, the first power link, the head and rod ends of power linkage actuator 70, and tool pins 34, 36. The arcuate portions of the collars define notch openings that are dimensioned to be readily engaged and disengaged with the tool pins when the collars are oriented in positions where the notch openings are facing the tool pins during assembly and disassembly.

As best seen in FIGS. 9 and 10, at least one of the collar 72 at the rod end 76 of power linkage actuator 70, and the collar 74 at the head end 78 of power linkage actuator 70 may include one of an arcuate tongue 73 and an arcuate groove 52 configured for slidable engagement with one of a mating arcuate groove 52 and arcuate tongue 73, respectively, formed on one of stick nose clevis-type collar 23 and first power link clevis-type collar 37. This tongue and groove configuration maintains the collars 72, 74 at each end of power linkage actuator 70 in a coaxially and slidably engaged relationship with the clevis-type collars 37, 23 on the first end of first power link 31 and on the stick nose, respectively. One of ordinary skill in the art will recognize that the tongue and groove configuration may be replaced with other alternative configurations that allow for coaxial rotation of the mating parts at the tool engagement interfaces. Alternative configurations for the tool engagement interfaces may include ball bearings and a rolling engaged relationship.

Figure 12:
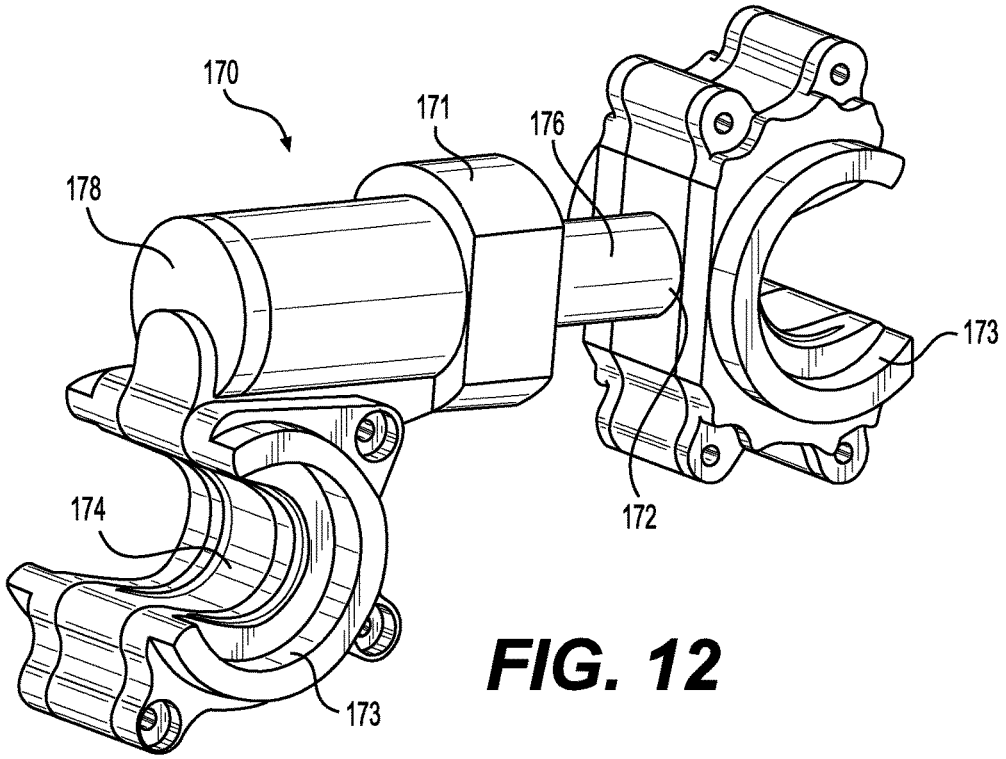
FIG. 12 is a perspective view of an alternative embodiment of a power linkage hydraulic actuator.
Figure 13:
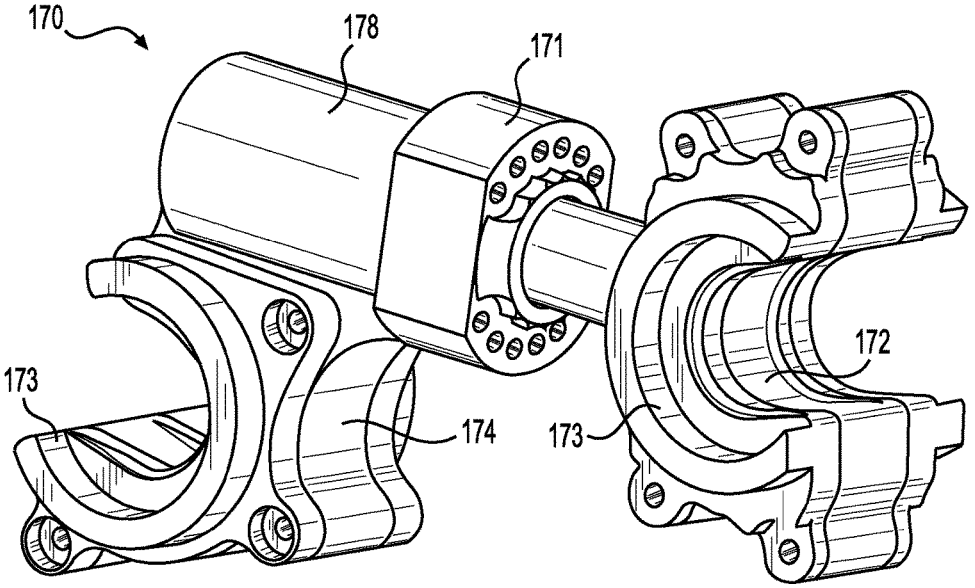
FIG. 13 is another perspective view of the alternative embodiment of the power linkage hydraulic actuator shown in FIG. 12.

In an alternative embodiment illustrated in FIGS. 12 and 13, a power linkage actuator 170 may be configured such that head end 178 is offset from a head end collar 174. This configuration results in an offset between the central axis of the power linkage actuator and the point of application of the force generated by extension and retraction of power linkage actuator 170. Head end collar 174 may be configured to be coaxially and slidably engaged with stick nose clevis-type collar 23. This embodiment may provide more room for attachment and access to hydraulic fluid lines that supply fluid to power linkage actuator 170. Head end 178 may be provided with an end cap 171 that seals around the rod protruding from a piston within head end 178. End cap 171 may provide a stop against which a rod end collar 172 bottoms out when power link actuator 70 is in a fully retracted position. Both rod end collar 172 and head end collar 174 may be fabricated from three separate parts that are bolted together or otherwise joined after assembly of two outer parts with arcuate tongue portions 173 into mating arcuate grooves 52 in stick nose clevis-type collar 23 and first power link clevis-type collar 37. With the arcuate tongue portions 173 inserted into the mating arcuate grooves 52, a central collar portion at the rod end 176 and a central collar portion at the head end 178 may be inserted in between the two outer parts, and the three parts may be fastened together to complete each of head end collar 174 and rod end collar 176.

Tool coupler assembly 40 may be part of a hydraulic system that also includes a power source, a hydraulic pump, hydraulic fluid lines, hydraulic cylinder 30, and power linkage actuator 70. The power source may drive the pump that draws hydraulic fluid from a low pressure reservoir and pressurizes the fluid for use by hydraulic cylinder 30 and power linkage actuator 70. A bucket control valve may be located within a supply passage, between the pump and hydraulic cylinder 30, to affect movement of hydraulic cylinder 30 in response to input received from, for example, an operator interface device located within operator station 16.

The bucket control valve may regulate operation of hydraulic cylinder 30 and, thus, the motion of tool 18 relative to stick member 24. Specifically, the bucket control valve may have elements movable to control a flow of pressurized fluid from the pump to head-end 30A and rod-end 30B of hydraulic cylinder 30, and from the head- and rod-ends 30A, 30B to a reservoir via a drain passage. In response to a command from an operator interface device to extend hydraulic cylinder 30, the elements of the bucket control valve may move to allow the pressurized fluid from the pump to enter and fill head-end 30A of hydraulic cylinder 30 via a supply passage and a head-end passageway, while simultaneously draining fluid from rod-end 30B of hydraulic cylinder 30 to the reservoir via a rod-end passage and drain passage. In response to a command from an operator interface device to retract hydraulic cylinder 30, the elements of the bucket control valve may move to allow pressurized fluid from the pump to enter and fill rod-end 30B of hydraulic cylinder 30 via a supply passage and a rod-end passage, while simultaneously draining fluid from head-end 30A of hydraulic cylinder 30 to the reservoir 106 via the head-end passage and the drain passage.

Power linkage actuator 70 may also be operated by supplying and draining pressurized fluid from the head end and rod end of a hydraulic cylinder in order to create an extension force, a retraction force, or a balanced force that maintains power linkage actuator 70 at a fixed length. As will be described in more detail in the following section, operation of power linkage actuator 70 enables the quick coupling of collars at the head and rod ends with front and rear tool pins 34, 36 on tool 18. In addition, the mating arcuate tongue and groove feature of the collars enables each of the head and rod end collars of power linkage actuator 70 to be slidably and coaxially engaged with a corresponding clevis-type collar at the stick nose and at one end of the first power link.

INDUSTRIAL APPLICABILITY

The presently disclosed quick coupler assembly may be applicable to a variety of machines, such as excavators, backhoes, loaders, and motor graders, to increase the functionality of these machines. For example, a single excavator may be used for moving dirt, rock and other material, and during the excavation operations, different implements may be required such as a different size of bucket, an impact breaker, or a grapple. The disclosed tool coupler assembly can be used to quickly change from one implement to another with ease, thus reducing the time the machine is unavailable for its intended purpose. The above-discussed features of each of the tool engagement interfaces, including head end and rod end collars on the power linkage actuator 70, which enable the collars to be slidably and coaxially engaged with mating stick nose clevis-type collar 23 and first power link clevis-type collar 37, also allow power linkage actuator 70 to be coaxially rotated around front and rear tool pins 34, 36. Power linkage actuator 70 can remain at a constant length during rotation of tool 18 around tool pivot axis 32. Moreover, as discussed above, the only two positions at which power linkage actuator 70 must maintain an extension force in order to ensure firm engagement with tool pins 34, 36 of tool 18 are at full retraction and full extension of hydraulic cylinder 30 (the tool control actuator). At all positions of tool coupler assembly 40 where hydraulic cylinder 30 is in between full retraction and full extension, such as the intermediate position shown in FIG. 11, tool pins 34, 36 are retained by interference with the collars.

As discussed above, the notch opening in the collar 74 at the head end of power linkage actuator 70 aligns with the notch opening in stick member clevis-type collar 23 when hydraulic actuator 30 (the tool control actuator) is fully retracted. The notch opening in the collar 72 at the rod end of power linkage actuator 70 aligns with the notch opening in first power link clevis-type collar 37 when hydraulic cylinder 30 is fully extended.

An extension force may be generated by power linkage actuator 70 to retain front tool pin 34 within the aligned notch openings of head end collar 74 and stick member clevis-type collar 23 when hydraulic cylinder 30 is fully retracted. Additionally, an extension force may be generated by power linkage actuator 70 to retain rear tool pin 36 within the aligned notch openings of rod end collar 72 and first power link clevis-type collar 37 when hydraulic cylinder 30 is fully extended. As discussed above, one of ordinary skill in the art will recognize that alternative embodiments may include power linkage actuator 70 comprising an electric actuator, and electro-hydraulic actuator, an electro-mechanical actuator, a manual screw actuator, or any other type of actuator configured to perform substantially the same functional specifications described above.

In one exemplary implementation of the tool coupler assembly in accordance with this disclosure, the coupling of a tool to the stick member 24 may begin with hydraulic cylinder 30 in a fully retracted position, and head end 78 of power linkage actuator 70 oriented relative to the stick nose such that the notches in head end C-shaped collar 74 and stick nose clevis-type collar 23 are aligned, as shown in FIG. 3. In this position, head end C-shaped collar 74 and stick nose clevis-type collar 23 may be engaged with front tool pin 34 on tool 18.

Once front tool pin 34 is fully seated within the notches of head end C-shaped collar 74 and stick nose clevis-type collar 23, hydraulic cylinder 30 may be extended, which results in head end C-shaped collar 74 rotating relative to and coaxially with stick nose clevis-type collar 23, as shown in FIG. 11. The angular offset between head end C-shaped collar 74 and stick nose clevis-type collar results in front tool pin 34 being prevented from engaging or disengaging with the notches in the collars.

Hydraulic cylinder 30 may continue to extend, causing first power link clevis-type collar 37 and rod end C-shaped collar 72 to rotate coaxially relative to each other until reaching the fully extended position of hydraulic cylinder 30. As shown in FIGS. 6-8, notch openings in first power link clevis-type collar 37 and rod end C-shaped collar 72 are aligned and able to engage with rear tool pin 36. Once the collars are fully engaged with rear tool pin 36, power linkage actuator 70 may apply an extension force against rod end collar 72 and rear tool pin 36 to prevent tool pin 36 from becoming disengaged with rod end collar 72 and first power link clevis-type collar 37. As discussed above, power linkage actuator 70 can maintain a constant length throughout the full range of motion of tool 18 relative to stick member 24. An extension force generated by power linkage actuator 70 may only be needed at the fully retracted and fully extended positions of hydraulic actuator 30 since these are the only positions where the notches of mating collars are aligned such that the collars could disengage from the tool pins.

It will be apparent to those skilled in the art that various modifications and variations can be made to the tool coupler assembly of the present disclosure without departing from the scope of the disclosure. Other embodiments will be apparent to those skilled in the art from consideration of the specification and practice of the tool coupler assembly disclosed herein. For example, although the disclosed tool coupler assembly is shown as having C-shaped collars with arcuate tongue and groove features, other features may be provided that also allow slidable and coaxial engagement between mating collars. It is intended that the specification and examples be considered as exemplary only, with a true scope of the disclosure being indicated by the following claims and their equivalent.

We claim:

1. A tool coupler assembly, comprising:

a power linkage assembly, the power linkage assembly including a first power link, wherein the first power link includes:

a first end configured for pivotally connecting the first end of the first power link to a tool at a first tool engagement interface;

a second, opposite end configured for pivotal connection to one end of a tool control actuator, the tool control actuator being connected at an opposite end to a first end of a tool support member of a machine, wherein operation of the tool control actuator pivots the tool about a tool pivot axis coaxial with a second tool engagement interface at a second end of the tool support member; and a power linkage actuator including a collar at a first end and a collar a ta second end, the power linkage actuator being pivotally connected at the first end for coaxial rotation with the second tool engagement interface at the second end of the tool support member, and at the second end for coaxial rotation with the first tool engagement interface at the first end of the first power link.

2. The tool coupler assembly of claim 1, wherein the power linkage assembly further includes a second power link pivotally connected at a first end to the tool support member at a point intermediate the first and second ends of the tool support member, and pivotally connected at a second end opposite the first end to the second end of the first power link.

3. The tool coupler assembly of claim 1, wherein the second tool engagement interface at the second end of the tool support member comprises a clevis collar including a notch opening configured to engage with a first pin connected to the tool coaxially with the tool pivot axis, and the first end of the first power link comprises a clevis collar including a notch opening configured to engage with a second pin connected to the tool at a position spaced from the tool pivot axis.

4. The tool coupler assembly of claim 3, wherein each of the tool control actuator and the power linkage actuator comprises at least one of a hydraulic cylinder, an electric actuator, an electrohydraulic actuator, an electro-mechanical actuator, or a manual screw actuator.

5. The tool coupler assembly of claim 3, wherein the first and second pins are connected to at least one bracket joined with an upper surface of the tool, with the second pin being located behind the first pin, and wherein at least one of the collar notch opening at the second end of the tool support member and the collar notch opening at the first end of the first power link are configured to engage with one or more bushings mounted on the first pin and the second pin, respectively.

6. The tool coupler assembly of claim 3, wherein each of the first end and the second end of the power linkage actuator includes a collar with a notch opening configured to engage with one of the first pin and the second pin connected to the tool.

7. The tool coupler assembly of claim 6, wherein at least one of the collars at the first and second ends of the power linkage actuator includes one of an arcuate tongue and an arcuate groove configured for slidable engagement with one of a mating arcuate groove and an arcuate tongue, respectively, formed on one of the tool support member clevis collar and the first power link clevis collar.

8. The tool coupler assembly of claim 7, wherein the notch opening in the collar at the first end of the power linkage actuator aligns with the notch opening in the tool support member clevis collar when the tool control actuator is fully retracted, and wherein the notch opening in the collar at the second end of the power linkage actuator aligns with the notch opening in the first power link clevis collar when the tool control actuator is fully extended.

9. The tool coupler assembly of claim 8, wherein an extension force generated by the power linkage actuator retains the first pin within the aligned notch openings of the collar at the first end of the power linkage actuator and the tool support member clevis collar when the tool control hydraulic cylinder is fully retracted, and retains the second pin within the aligned notch openings of the collar at the second end of the power linkage actuator and the first power link clevis collar when the tool control hydraulic cylinder is fully extended.

10. A machine, comprising:

a base frame;

a boom member pivotally connected at one end to the base frame;

at least one actuator connected to move the boom member relative to the base frame;

a stick member pivotally connected at a first end to the boom member;

at least one actuator connected between the boom member and the stick member to move the stick member relative to the boom member;

a tool pivotally connected to a second end of the stick member opposite from the first end; and a tool coupler assembly, comprising:

a power linkage assembly, the power linkage assembly including a first power link, wherein the first power link includes:

a first end configured for pivotally connecting the first end of the first power link to the tool at a first tool engagement interface;

a second, opposite end configured for pivotal connection to one end of a tool control actuator, the tool control actuator being connected at an opposite end to a first end of the stick member, wherein operation of the tool control actuator pivots the tool about a tool pivot axis coaxial with a second tool engagement interface at the second end of the stick member; and a power linkage actuator including a collar at a first end and a collar at a second end, and the power linkage actuator being pivotally connected at the first end for coaxial rotation with the second tool engagement interface at the second end of the stick member, and at the second end for coaxial rotation with the first tool engagement interface at the first end of the first power link.

11. The machine of claim 10, wherein the power linkage assembly further includes a second power link pivotally connected at a first end to the stick member at a point intermediate the first and second ends of the stick member, and pivotally connected at a second end opposite the first end to the second end of the first power link.

12. The machine of claim 10, wherein the second tool engagement interface at the second end of the stick member comprises a clevis collar including a notch opening configured to engage with a first pin connected to the tool coaxially with the tool pivot axis, and the first end of the first power link comprises a clevis collar including a notch opening configured to engage with a second pin connected to the tool at a position spaced from the tool pivot axis.

13. The machine of claim 12, wherein the first and second pins are connected to at least one bracket joined with an upper surface of the tool, with the second pin being located behind the first pin, and wherein at least one of the collar notch opening at the second end of the tool support member and the collar notch opening at the first end of the first power link are configured to engage with one of more bushings mounted on the first pin and the second pin, respectively.

14. The machine of claim 10, wherein each of the tool control actuator and the power linkage actuator comprises at least one of a hydraulic cylinder, an electric actuator, an electrohydraulic actuator, an electro-mechanical actuator, or a manual screw actuator.

15. The machine of claim 10, wherein each of the first end and the second end of the power linkage actuator includes a collar with a notch opening configured to engage with one of the first pin and the second pin connected to the tool.

16. The machine of claim 15, wherein at least one of the collars at the first and second ends of the power linkage actuator includes one of an arcuate tongue and an arcuate groove configured for slidable engagement with one of a mating arcuate groove and arcuate tongue, respectively, formed on one of the stick member clevis collar and the first power link clevis collar.

17. The machine of claim 16, wherein the notch opening in the collar at the first end of the power linkage actuator aligns with the notch opening in the stick member clevis collar when the tool control actuator is fully retracted, and wherein the notch opening in the collar at the second end of the power linkage actuator aligns with the notch opening in the first power link clevis collar when the tool control actuator is fully extended.

18. The machine of claim 17, wherein an extension force generated by the power linkage actuator retains the first pin within the aligned notch openings of the collar at the first end of the power linkage actuator and the stick member clevis collar when the tool control hydraulic cylinder is fully retracted, and retains the second pin within the aligned notch openings of the collar at the second end of the power linkage actuator and the first power link clevis collar when the tool control hydraulic cylinder is fully extended.

19. A tool coupler assembly, comprising:

a power linkage assembly, the power linkage assembly including a first power link, wherein the first power link includes:

a first end configured for pivotally connecting the first end of the first power link to a tool at a first tool engagement interface;

a second, opposite end configured for pivotal connection to one end of a tool control hydraulic cylinder, the tool control hydraulic cylinder being connected at an opposite end to a first end of a tool support member of a machine, wherein operation of the tool control hydraulic cylinder pivots the tool about a tool pivot axis coaxial with a second tool engagement interface at a second end of the tool support member; and a power linkage hydraulic cylinder including a collar at a first end and a collar at a second end, and the power linkage hydraulic cylinder being pivotally connected at the first end for coaxial rotation with the second tool engagement interface at the second end of the tool support member, and at the second end for coaxial rotation with the first tool engagement interface at the first end of the first power link.

* * * * *